US005279373A

United States Patent [19]

Smet

[11] Patent Number: 5,279,373

[45] Date of Patent: Jan. 18, 1994

[54] CONTROLLABLE DRILL HEAD

[76] Inventor: Marc J. M. Smet, Kasteelstraat 29, 2400 Mol, Belgium

[21] Appl. No.: 826,880

[22] Filed: Jan. 28, 1992

[30] Foreign Application Priority Data

Jan. 28, 1991 [BE] Belgium ..... 09100068

[51] Int. Cl.[5] ..... E21B 21/10

[52] U.S. Cl. ..... 175/38; 175/67; 175/90

[58] Field of Search ..... 175/67, 424, 38

[56] References Cited

U.S. PATENT DOCUMENTS

| | | | |
|---|---|---|---|
| 2,251,916 | 8/1941 | Cross | 175/67 |
| 2,258,001 | 10/1941 | Chamberlain | 175/67 |
| 2,271,005 | 1/1942 | Grebe | 175/67 |
| 2,745,647 | 5/1956 | Gilmore | 175/424 |
| 3,190,374 | 6/1965 | Caperan et al. . | |
| 4,168,752 | 9/1979 | Sabol | 175/67 |
| 4,369,850 | 1/1983 | Barker | 175/424 |
| 4,396,073 | 8/1983 | Reichman et al. . | |
| 4,615,399 | 10/1986 | Schoeffler | 175/48 |
| 4,624,326 | 11/1986 | Loegel, Jr. | 175/67 |
| 4,655,299 | 4/1987 | Schoeffler . | |
| 4,787,463 | 11/1988 | Geller et al. | 175/424 |
| 4,957,173 | 9/1990 | Kinnan . | |

FOREIGN PATENT DOCUMENTS

| | | |
|---|---|---|
| 906079 | 4/1987 | Belgium . |
| 0401191 | 12/1990 | European Pat. Off. . |
| WO8600111 | 1/1986 | PCT Int'l Appl. . |

*Primary Examiner*—Ramon S. Britts
*Assistant Examiner*—Frank S. Tsay
*Attorney, Agent, or Firm*—Oblon, Spivak, McClelland, Maier & Neustadt

[57] ABSTRACT

Controllable drill head containing an elongated body of which one end is attached to a bore pipe and a spout element is mounted in a turnable manner on the other, foremost end of the body, in and opposite to an opening in this body, wherein the head contains an elongated, elastic, bendable element which at one end carries the spout element and which has been mounted in the body in such a manner that when being in a rest position the movable element stretches out in the longitudinal direction of the body, but which is elastically bendable in the cross direction of the body so as to alter the direction of the spout element through bending, a mechanism for (3) stopping the foremost end of the bendable element with the spout element in the forward direction without the element bending through and to keep the spout element from changing direction, and a mechanism for exerting forward pressure on a part of the bendable element which is situated further away from the foremost end of the body than the foremost end thereof which is stopped by the body so as to provoke bending through of the bendable element.

21 Claims, 2 Drawing Sheets

CONTROLLABLE DRILL HEAD

BACKGROUND OF THE INVENTION

Field of the Invention

The present invention concerns a controllable drill head containing an elongated body of which one end is meant to be attached to a bore pipe and a spout element which has been mounted in a turnable manner on the other, foremost end of the body, in and opposite an opening in this body.

Discussion of the Background

In the known drill heads of this type, the spout element has been mounted in a nozzle which is, in turn, mounted in a rotatable manner on the foremost end of the body and by means of jacks acting on the backside of the nozzle. Such a drill head is described in patent BE-A-906 079.

The jacks are operated from above the ground and are connected onto separate pipes supplying the required energy, for example hydraulic pipes in the case of hydraulic jacks. All this makes the construction of the drill head relatively complicated and costly.

SUMMARY OF THE INVENTION

The invention aims to correct said disadvantages and to provide a controllable drill head having a relatively simple construction and which is thus relatively cheap, but which can be controlled in a very precise manner.

To this aim the controllable drill head contains an elongated, elastic, bendable element which at one end carries the spout element and which is mounted in the body in such a manner that when being in its rest position it stretches out in the longitudinal direction of the body, but which is elastically bendable in the cross direction of the body so as to alter the direction of the spout element through bending, means for stopping the foremost end of the bendable element with the spout element in the forward direction without the element bending through and to keep the spout element from changing direction, and means to exerting a forward pressure on a part of the bendable element which is situated further away from the foremost end of the body than the foremost end of it which is stopped by said body so as to provoke the bending through of the bendable element.

According to a special embodiment of the invention, the controllable drill head contains a guide in the body for the bendable element so as to guide the bendable element as it bends through, such that the bending takes place in a certain cross direction.

Since the moving direction of the drill head is determined by the direction of the spout element, this direction can be precisely set in this embodiment since, insofar the position of the body around its longitudinal axis is known from for example measuring equipment mounted in the body, the bending direction of the elastic element can be precisely known.

According to a remarkable embodiment of the invention the means for stopping the foremost end of the bendable element with the spout element comprises an edge on the foremost end of the body which is turned towards the longitudinal axis and with which the foremost end of the spout element connects.

Although the flexible element can be independent of the supply of fluid to the spout element, according to an economical embodiment of the invention, the bendable element is a flexible pipe which connects onto the spout element and through which fluid under pressure is supplied.

According to a preferred embodiment of the invention, the means for exerting a forward pressure contain a piston which is connected to the bendable element and which confines a room in the body in which ends up a supply for fluid.

Since the direction of the spout element is determined by the bending direction of the elastic element, and in particular when the bending direction is determined by a guide, it is necessary in order to change this direction that the elastic element with the spout element is rotated in relation to the longitudinal direction of the body. Naturally, this can be done by rotating the entire body together with everything which has been mounted in it, which can be done in a relatively precise manner if the bore pipe is a rigid but yet bendable pipe, consisting for example of hollow drilling rods. If, however, the bore pipe is a flexible tube, rotating of the body through the agency of said tube can hardly be done in a precise manner. Among others in the latter case, the whole formed by the bendable element and the spout element can be rotated in the body.

Also, according to a particular embodiment of the invention, the controllable drill head contains means which have been mounted in the body to rotate the whole assembly formed by the bendable element and the spout element mounted on it around the longitudinal direction according to which the bendable element stretches out in its rest position.

These means may contain an electric, hydraulic or pneumatic motor, but preferably they contain a screwed rod which is connected to the elastic bendable element and is directed in the longitudinal direction of the body and a nut element screwed onto this screwed rod, means for keeping said nut element from rotating in relation to the body without keeping it from moving in the longitudinal direction of the body and means for moving the nut element over the screwed rod.

Such movement of the nut element automatically causes a rotation of the screwed rod and thus of the bendable element connected to it.

The nut element is preferably a piston element which at at least one side confines a room in the body in which ends up a supply pipe for fluid under pressure. This room is preferably connected to the spout element, such that the fluid under pressure which is supplied to the spout element also acts on the piston element. The same fluid under pressure which is used for the spouting of the spout head can be used, preferably after a pressure increase, to move the piston element.

BRIEF DESCRIPTION OF THE EMBODIMENTS

Other details and advantages of the invention will become clear from the following description of a controllable drill head according to the invention. This description is given as an example only without limiting the invention in any way, with reference to the according drawings, where:

Figure 1:
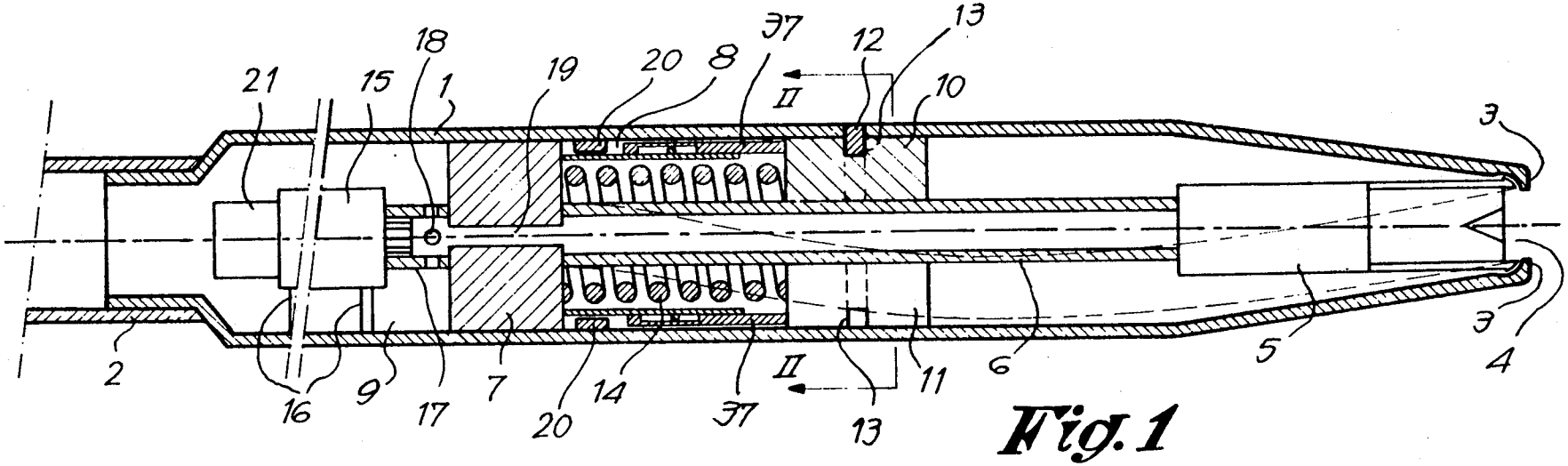
FIG. 1 is a longitudinal section of a controllable drill head according to the invention.
Figure 2:
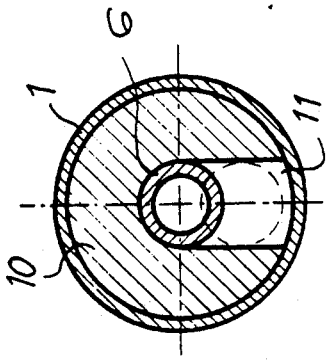
FIG. 2 is a cross section taken along line II—II in FIG. 1.

The drill head represented in FIGS. 1 and 2 contains a round, elongated body 1 which is connected onto a flexible bore pipe 2 with the rearmost end thereof. The body 1 becomes narrower in the front and is provided on the fore end with an edge 3 directed towards the longitudinal axis whose side directed towards the inside of the body 1 is rounded off. This edge 3 surrounds an opening 4.

A spout element 5 is situated opposite the opening 4 in the body 1 and is stopped by the edge 3. This spout element 5 contains one or several jets which are either rotating or not. FIG. 1 shows a spout element 5 with one rotating jet. The stationary casing of the spout element 5 has an utmost edge in front which corresponds to the above-mentioned rounding of the edge 3, such that the spout element 5 can rotate in any direction at a restricted angle in relation to the edge 3 just like the ball in a ball fitting.

The spout element 5 is supported by an elastic bendable pipe 6 which also forms the supply pipe for fluid under pressure to the spout element 5. Whereas the foremost end of the pipe 6 is connected to the stationary part of the spout element 5, the rearmost end of it is connected to a piston 7 which has been mounted in the body 1 in a sliding manner and divides the inside of said body in a front room 8 which is free of fluid and a rear chamber 9 which is connected to the above-mentioned bore pipe 2.

Between the spout element 5 with which the pipe 6 leans on the body 1 in the front and the piston 7 which supports the rearmost end of the pipe 6, this pipe 6 can bend through in the radial direction of the body 1. However, the bending can only be directed in one radial direction by a guide which includes of a round disc 10 which fits within the body 1, crosswise to the longitudinal direction, and through which the pipe 6 extends. A pin 12 which has been applied in the wall of the body 1 fits in a groove 13 running over the circumference of the disc 10 such that the disc 10 can rotate round the longitudinal axis of the body 1, but cannot shift along its longitudinal direction. In order to enable the pipe 6 to bend through, a recess 11 has been provided in the disc 10 from the central opening through which the pipe 6 sticks in one radial direction onto its addendum circle, over its full girth, whereby the width of said recess 11 equals the diameter of the pipe 6.

Between the piston 7 and the guide formed by disc 10 and recess, 11 the pipe 6 is surrounded by a coil spring 14 which counteracts the forward movement of the piston 7.

The entire assembly including the pipe 6, the spout element 5, the piston 7 and the disc 10 can be rotated by means of an electric motor 15 which is attached to the body 1 by means of a support 16. In order to make the disc 10, through which the pipe 6 loosely sticks, rotate together with the piston 7 which has been attached to this pipe 6, the disc 10 and the piston 7 are connected to one another by means of a telescopic pipe 37 which surrounds the spring 14 and only allows for a relative axial movement of the piston 7 in relation to the disc 10, but not for a relative rotation. The slidable parts of the telescopic pipe are kept from rotating in relation to one another by means of pins on the first part sticking through axially directed grooves in the other part.

The outwardly extending shaft of the motor 15 is connected to the piston 7 by means of a piece of pipe 17 situated in line with the pipe 6. The wall of the piece of pipe 17 has been provided with a number of openings 18 whereas the piston 7 also has been provided with an axial passage 19 through which the interior of the piece of pipe 17 and the interior of the pipe 6 are connected with one another. Through the openings 18, the piece of pipe 17, the passage 19 and the pipe 6 fluid flows from the chamber 9 to the spout element 5.

For boring in a straight line, fluid is supplied to the chamber 9 and thus also to the spout element 5 at a pressure just below 200 bar. This pressure is sufficient for the spout element 5 to spout off the ground in front of the body, but insufficient for the piston 7 to be moved forward against the spring 14. The elements in the body are in the position shown in the FIGS. 1 and 2 whereby the pipe 6 stretches out in the body 1 in a straight, axial line and whereby the spouting by the spout element 5 is also done in an axial direction.

If the pressure of the fluid which is supplied to the drill head is increased to over 200 bar, the pressure on the piston 1 is sufficient to compress the spring 14 and make the pipe 6 bend through sideways at the same time. As a result of this pressure the piston 7 is moved forward onto a stop 20 mounted on the inner wall of the body 1. Hereby, the pipe 6 is maximally bent through so that it touches or almost touches the inner wall of the body 1 at the height of the guide 10, 11, as represented by the dotted line in the FIGS. 1 and 2. Thus, the spout element 5 directed in the extension of the foremost end of the bent pipe 6 is at an angle in relation to the longitudinal direction of the body 1. By rotating the pipe 6 in relation to the longitudinal axis of the body 1 by means of the motor 15, which is operated from above the ground, the spouting direction of the spout element 5 can be altered, although always at the same angle in relation to the longitudinal axis. Together with the bent pipe 6, the pipe 7 and the disc 10 also rotate.

By means of detection equipment 21 connected onto the casing of the motor 15, the position and inclination of the body 1 in the ground and the position of the pipe 6 around the longitudinal axis of the body can be detected. This information can then be sent, for example via a transmitter, to a receiver erected above the ground.

By reducing the fluid pressure again, through the elasticity of the pipe 6 and through the spring 14, the piston 7 is pressed into its initial position again and the pipe 6 with the spout element 5 assumes its initial position again. The embodiment of the drill head according to FIG. 3 only differs from the embodiment described above in that the means for rotating the bent pipe 6 does not include an electric motor whose current supply pipes have been applied via the bore pipe 1, but instead includes a hydraulic type motor which is driven by the same fluid which is supplied to the spout element 5 and which thus does not require a separate energy supply pipe.

This "hydraulic" motor mainly consists of a hollow screwed rod 22 and a nut 23 screwed onto it which at the same time forms a piston element in the body 1.

The hollow screwed rod 22 replaces the piece of pipe 17 and includes a pipe provided on the outside with screw thread which, in line with the pipe 6 in a resting state, stretches out centrally in the body between the piston 7 fixed onto it and the detection equipment 21 fixed on the body 1 by means of the support 16. The nut 23 contains a central body 24 having an outside diameter which corresponds to the inside diameter of the body 1, and two round ends 25 and 26 having a smaller diameter which, respectively in front and at the back of the body 24, stick through openings in partition walls 27 which divide the chamber 9 in to chambers 28, 29 and 30. The body 24 is situated in the middle chamber 29. The end 25 which reaches the front chamber 28 has a diameter which is slightly larger than the diameter of the rearmost end 26 which reaches the rear chamber 30. Around the two ends 25 and 26, sealings 31 have been applied in the partition walls 27.

In the rear chamber 30, openings 32 have been made in the hollow screwed rod 22, such that the fluid under pressure which ends up in the rear chamber 30 via the bore pipe 2, can reach the spout element 5 through the screwed rod 22, the passage 19 in the piston 7 and the pipe 6. This fluid can also flow in the front chamber 28 through openings 33 in the screwed rod 22 which, also when the piston 7 is in its rearmost position, end up in the compartment 9. Because the diameter of the foremost end 25 is bigger than the diameter of the rearmost end 26, said fluid exerts a resulting, rearwardly directed power on the nut 23. Rearward movement of said nut 23 is counteracted by a prestressed coil spring 34 placed around the rearmost end 26, between the rear partition wall 27 and the rear side of the body 24.

The nut 23 is kept from rotating by a pin 35 attached on the body 1 and placed in a groove 36 which stretches out in the longitudinal direction of the body 1 on the outside of the body 24 of the nut 23.

The spring 34 has been selected such that the nut 23 is only moved rearward by the fluid under pressure if the pressure of said fluid is higher than the pressure at which, as described above, the piston 7 is moved forward whereby the pipe 6 is bent. As a result of this movement of the nut 23, the screwed rod 22 automatically rotates around its axis, as a result of which the bent pipe 6 also starts to rotate.

Figure 3:
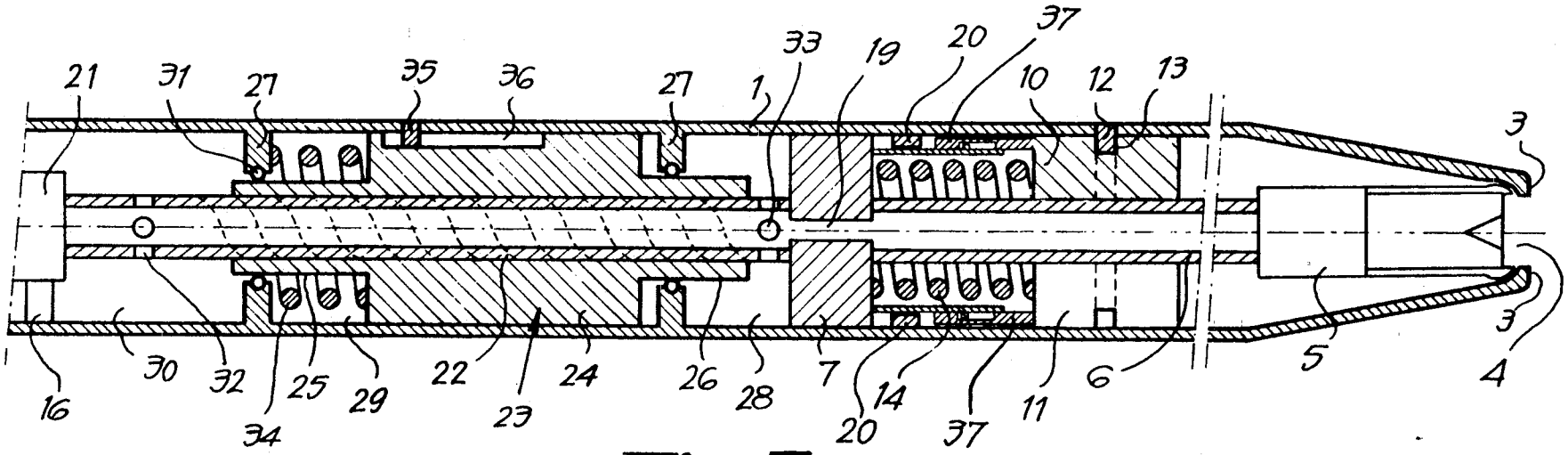
FIG. 3 shows a cross section analogous to that in FIG. 1, but with relation to another embodiment of the controllable drill head according to the invention.

If the fluid pressure is lower than 200 bar, all the parts are in the position shown in FIG. 3 and the spout element 5 spouts according to the longitudinal direction of the body 1. If the pressure is raised above 200 bar, the piston 7 is moved forward and the pipe 6 is bent as described above. In this case, the screwed rod 22 and the nut will be moved forward along with the piston 7 over a short distance. This forward movement is caused by the spring 34, such that the spring 11 should be somewhat heavier than in the previous embodiment. In addition, if the pressure of the fluid is even higher, for example above 205 bar, the nut 23 will be moved rearward over a distance which depends on the applied pressure. The piston 7 remains pressed against the stop 20 because of this higher pressure in the chamber 28. Depending on the magnitude of this movement, the threaded rod 22 will turn less or more. For the maximum rearward movement of the nut 23 the threaded rod 22 makes nearly one entire rotation.

The construction of the drill heads described above is relatively simple. The spout head can be relatively precisely directed in any sidewise direction without therefore having to interrupt the spouting of the spout head and thus the boring. In the embodiment according to FIG. 3, no extra pipe is needed to make the bendable pipe rotate. Both the bending and the rotation are obtained by altering the pressure of the fluid which is used for the spouting.

The present invention is in no way limited to the embodiments described above; on the contrary, these embodiments can be made in all sorts of variants while still remaining within the scope of the invention, among others as far as shape, composition, arrangement and the number of parts used are concerned.

In particular, the elastic bendable element does not necessarily have to be a pipe through which fluid is supplied to the spout element. This element may also be a lath or other moulding having any profile whatsoever, and the supply of fluid to the spout element can take place via this lath or moulding, if required in a non-elastic (flexible) bendable main.

The bendable pipe does not necessarily have to be fixed to the piston. It is sufficient if a forward movement of the piston causes a forward movement of the rear part of the pipe.

If the piston is not fixed to the pipe and there are means to make the pipe rotate, then these means should act directly on the pipe which, for example, can stretch out loosely through the piston. However, the guide should rotate in conjunction, and said means may be connected to the guide to make the latter rotate.

Especially in the first embodiment a spring to push the piston back into its initial position is not always required. The elasticity of the pipe, which may be made of steel for example, may suffice.

In the case where the piston and the disc to guide the pipe are connected with one another, this does not necessarily have to be by means of a telescopic pipe. An ordinary pipe or another axially directed element can be put with one end in an axially slidable manner in a recess in the piston and/or disc and can be kept from moving parallel with the perimeter of the piston and/or the disc by for example a tenon and mortise joint.

I claim:

1. Controllable drill head which comprises:

an elongated body having one end attached to a bore pipe and a spout element mounted in a turnable manner on the other, foremost end of the body, in and opposite to an opening in this body, an elongated, elastic, bendable element which at one end carries the spout element and which is mounted in the body in such a manner that when in a rest position, the bendable element stretches out in the longitudinal direction of the body, but which is elastically bendable in the cross direction of the body so as to alter the direction of the spout element through bending, means for stopping the foremost end of the bendable element with the spout element in the forward direction without the bendable element bending through and for keeping the spout element from changing direction, and means for exerting a forward pressure on a part of the bendable element which is situated further away from the foremost end of the body than the foremost end thereof which is stopped by said body so as to provoke the bending through of the bendable element.

2. Controllable drill head according to claim 1, which comprises:

a guide for the bendable element provided in the body so as to guide said bendable element as the bendable element bends such that the bending takes place in a predetermined cross direction.

3. Controllable drill head according to claim 1, wherein the means for exerting a forward pressure comprises an edge on the foremost end of the body which is turned towards the longitudinal axis and with which the foremost end of the spout element is connected.

4. Controllable drill head according to claim 1, wherein the edge of the body turned towards the longitudinal axis is rounded off on the inside and forms a bearing for the foremost edge of the spout element, such that said spout element can pivot to a limited extent in any direction with relation to the body.

5. Controllable drill head according to claim 1, wherein the bendable element comprises a flexible pipe which is connected to the spout element and through which fluid under pressure is supplied to said spout element.

6. Controllable drill head according to claim 1, wherein the means for exerting a forward pressure comprises a piston connected to the bendable element and which confines a compartment in the body to which is communicated a supply for fluid under pressure.

7. Controllable drill head according to claim 1, wherein said compartment confined by the piston is connected to the spout element by means of a pipe and wherein the piston is movable by the fluid supplied to the spout element.

8. Controllable drill head according to claims 6 or 7, which comprises a spring-loaded element which is mounted in the body at the side of the foremost end in relation to the piston wherein the loaded element counteracts the forward movement of the piston.

9. Controllable drill head according to claim 2, wherein the spring-loaded element between the piston and the guide which has been mounted in the longitudinal direction of the body is immobile.

10. Controllable drill head according to claim 1, which comprises means mounted in the body for rotating the combination of the bendable element and the spout element mounted upon the bendable element around the longitudinal direction according to which the bendable element stretches out in the rest position thereof.

11. Controllable drill head according to claim 2, wherein the guide is mounted such that the guide is rotatable around the longitudinal axis of the body.

12. Controllable drill head according to claim 6, wherein the piston is irremovably connected to the bendable element and is connected to the guide by a connection which allows for axial movement, but not for a relative rotation of the piston in relation to the guide.

13. Controllable drill head according to claim 10, wherein the rotation means comprises a motor with an energy supply from outside the body.

14. Controllable drill head according to claim 10, wherein the rotation means comprises a rod which is connected to the elastic bendable element and is directed in the longitudinal direction of the body and a nut element screwed onto said rod, means for preventing said nut element from rotating in relation to the body without being kept from moving in the longitudinal direction of the body and means for moving the nut element over the rod.

15. Controllable drill head according to claim 14, wherein the nut element comprises a piston element which at at least one side thereof confines a compartment in the body in communication with a supply pipe for fluid under pressure.

16. Controllable drill head according to claim 15, wherein the compartment which is confined by the piston element at one side is connected to the spout element, such that the fluid under pressure which is supplied to the spout element also acts on the piston element.

17. Controllable drill head according to claim 15, wherein the nut element forms a part of the wall of the compartment in the body with both ends thereof and the compartment comprises two compartments connected with one another, whereby the wall parts of the two compartments differ from one another such that a resulting force is brought about in one direction according to the longitudinal direction of the body under the influence of the fluid under pressure in both compartments.

18. Controllable drill head according to claim 15, which comprises a spring which acts on the nut element for counteracting movement in the longitudinal direction of the body under influence of the fluid pressure.

19. Controllable drill head according to claim 18, wherein the compartment which is confined by the nut element is also confined by the piston.

20. Controllable drill head according to claim 8. wherein the spring which acts on the nut element is made such that when the fluid pressure increases, the piston is first moved and the bendable element is bent before the nut element is moved and thus before said bendable element is rotated.

21. Controllable drill head according to claim 20, wherein the rod comprises a hollow pipe which stretches out as an extension of the elastic bendable element in a rest position and is connected to the elastic bendable element and wherein the compartment which is confined by the nut element is in communication with the inside of said hollow pipe by means of at least one opening and receives fluid under pressure via said hollow pipe.

* * * * *